US005263339A

United States Patent [19]

Evans

[11] Patent Number: 5,263,339

[45] Date of Patent: Nov. 23, 1993

[54] PORTABLE COOLER

[75] Inventor: Scott Evans, 4334 Dawes St., San Diego, Calif. 92109

[73] Assignees: Scott Evans; Lance Degrazier; Scott Nuanez, San Diego, Calif.

[21] Appl. No.: 923,218

[22] Filed: Jul. 31, 1992

[51] Int. Cl.[5] ..... B31B 1/14; B65D 5/56

[52] U.S. Cl. ..... 62/457.7; 29/104; 220/418; 220/462; 493/96; 493/907

[58] Field of Search ..... 62/371, 372, 457.1, 62/457.7; 229/104, 111, 169; 206/140; 220/403, 416, 461, 418, 462; 53/175; 493/96, 95, 907

[56] References Cited

U.S. PATENT DOCUMENTS

| | | | |
|---|---|---|---|
| 1,950,582 | 3/1934 | Ware | 220/416 |
| 2,389,291 | 11/1945 | Bergstein | 220/403 |
| 2,717,731 | 9/1955 | Nerenberg | 220/418 |
| 3,399,546 | 9/1968 | Kuns et al. | 62/457.1 X |
| 3,829,000 | 8/1974 | Elllison | 493/96 X |
| 3,888,163 | 6/1975 | Watanabe | 493/95 X |
| 4,099,665 | 7/1978 | Bergstein | 220/403 |
| 4,571,232 | 2/1986 | Diehl | 493/96 |

OTHER PUBLICATIONS

Echelon Corporation, I. C. Pak Advertisement, (Boulder, Col.).

Malibu Products, Inc., Malibu Cooler Advertisement, (Chicago, Ill.).

Creative Industries, Inc., ThermalCor Advertisement, (Bridgeview, Ill.).

ThermoTech Plastics, Inc., ThermoPacker Advertisement, (Houston, Tex.).

Coolite, Thermal Bag Advertisement.

*Primary Examiner*—Henry A. Bennet
*Assistant Examiner*—William C. Doerrler
*Attorney, Agent, or Firm*—Lyon & Lyon

[57] ABSTRACT

Portable cooler having a base, a lid and four sidewalls, and further having an upper base and an inner sidewall and a liner shaped to fit within the four sidewalls, base and lid. The liner is fixedly attached to the inner sidewall and another sidewall, and is not fixedly attached to any other portion of the cooler.

2 Claims, 5 Drawing Sheets

PORTABLE COOLER

BACKGROUND OF THE INVENTION

This invention relates to portable coolers.

Portable coolers are well known in the art and are generally formed of insulated foam material or of a heavy duty plastic material which may be provided with some form of thermal insulating barrier. For example, Echelon Corporation (Boulder, Colo.) describe a foam-filled vinyl insert liner for a cooler; Malibu Product, Inc. (Chicago, Ill.) describe a cooler form from super-insulated polyethylene; Creative Industries (Bridgeview, Ill.) describe ThermalCor insulating board for use in various insulating products, such a board is formed of closed-cell material and is formed in a moisture proof form; Thermotech Plastics, Inc. (May 1, 1991) advertise an insulated bag for maintaining beverages cold with or without ice; and Coolite advertises a frozen food carrier formed as an insulated bag.

SUMMARY OF THE INVENTION

This invention relates to a portable cooler formed from an insulating material which is not naturally waterproof, but is provided with a waterproof liner attached to a flap within the portable cooler. The cooler is formed in such a way that it may be folded to a small size for ease in storage and carrying, and then quickly unfolded to form the cooler. Critical in the invention, as will be described below, is the provision of an internal flap within the cooler attached to the moisture proof lining which aids in formation of an internal moisture proof volume.

In preferred embodiments, the portable cooler is formed from cardboard and a plastic bag liner is provided attached to at least one flap in the cardboard.

Applicant has discovered a means for constructing a portable cooler which provides a convenient and inexpensive cooler, which can be unfolded to automatically form a desired portable cooler with a plastic liner intact. The cooler is reusable, and if so desired the plastic liner can be replaced or reused as necessary. The cooler is also recyclable, lightweight and easy to carry in one hand, will not crumble or break like styrofoam, and folds flat for storage or display.

Other features and advantages of the invention will be apparent from the following description of the preferred embodiments thereof, and from the claims.

DESCRIPTION OF THE PREFERRED EMBODIMENTS

The drawings will first briefly be described.

Drawings

Figure 9:
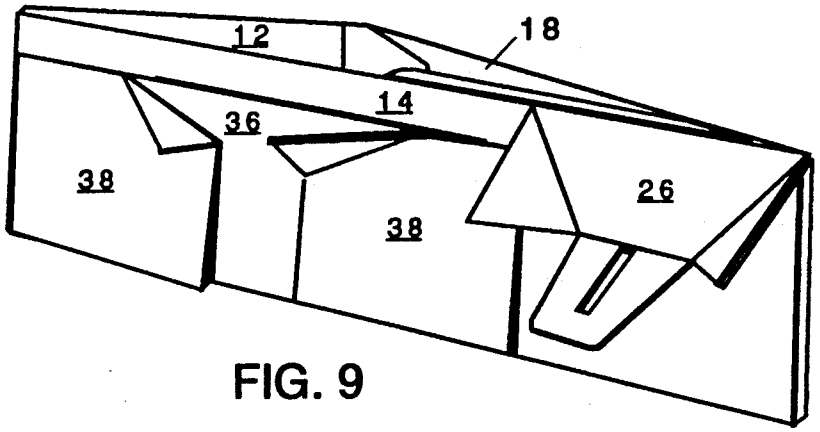
Figure 8:
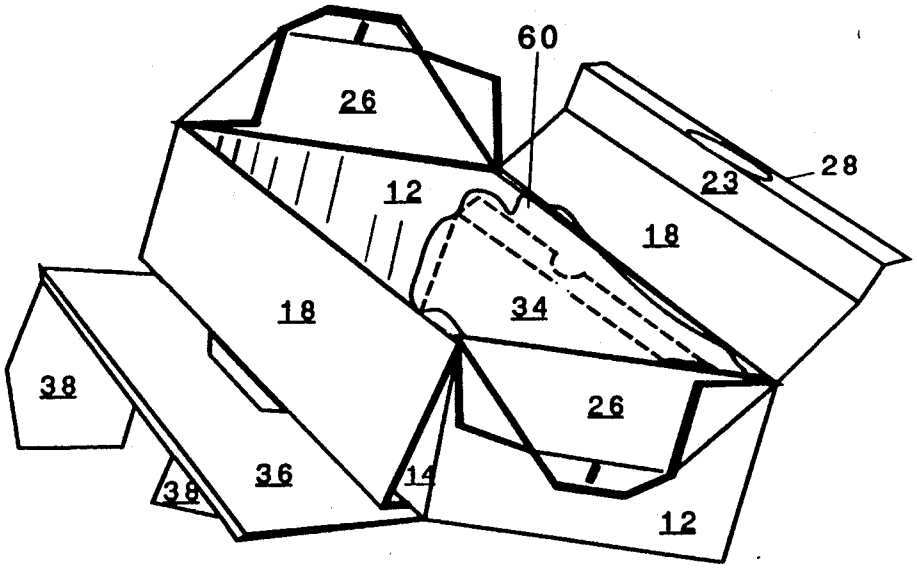
FIG. 8 is an isometric view showing a partial folding of the portable cooler.
Figure 10:
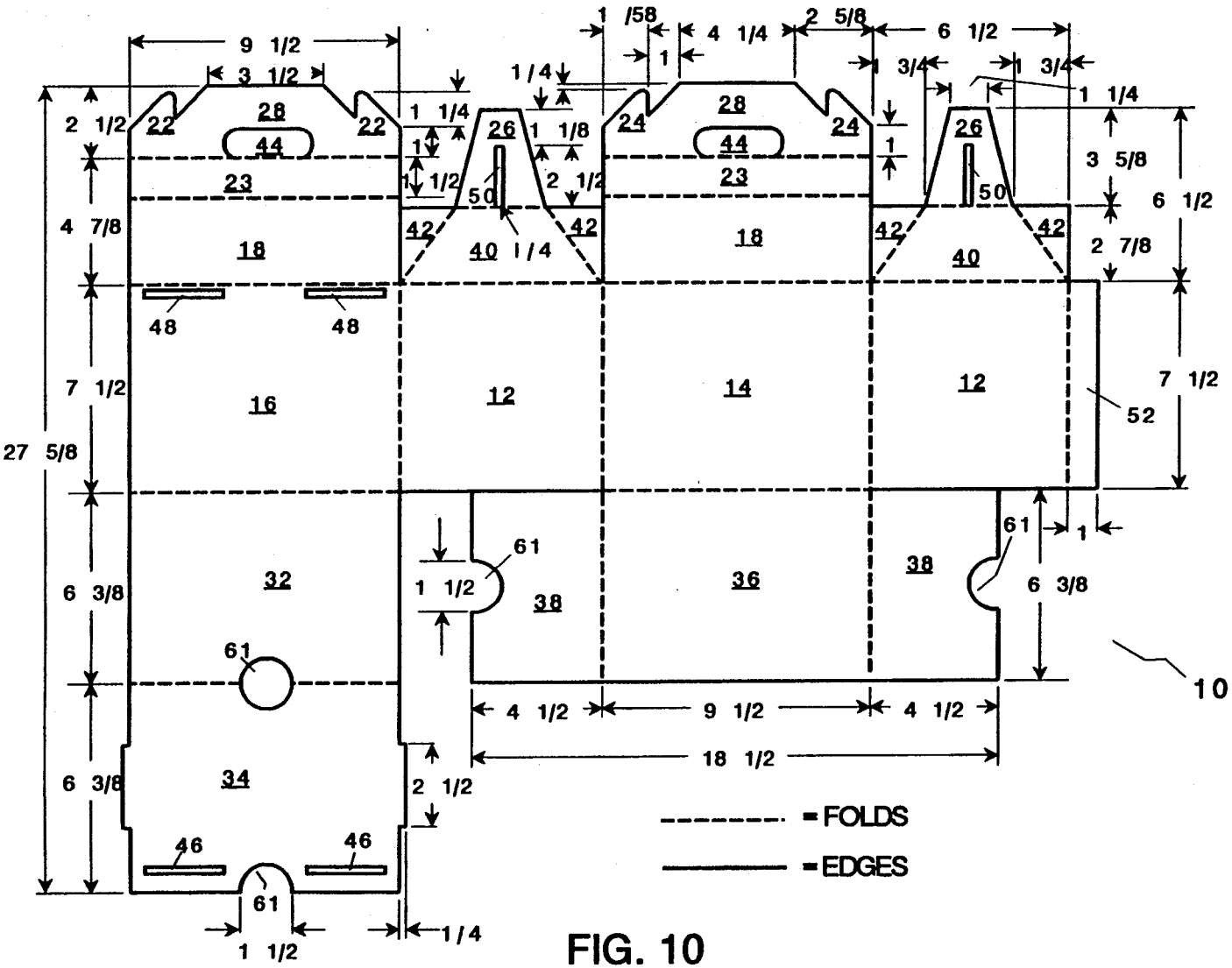

FIG. 9 is an isometric representation of a portable cooler in a folded position; and FIG. 10 is a top view of the shape of cardboard required to be cut to form a portable cooler of the invention. Solid lines represent the edges of the cardboard and dashed lines represent the folds to be formed to generate a portable cooler of the invention. The sizes in inches of various edges are provided as an example.

Structure

Figure 1:
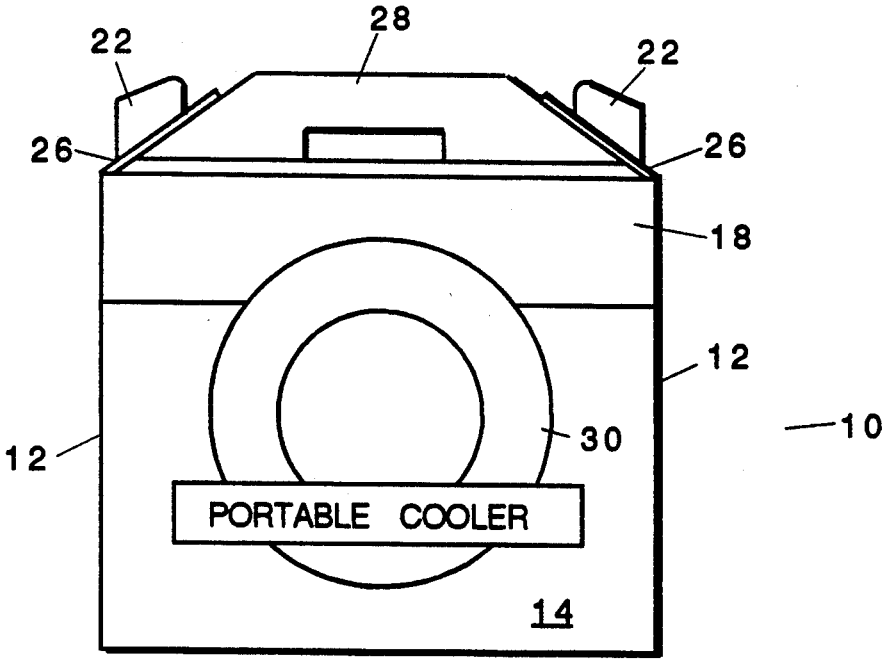
FIGS. 1 and 2 are front and side views of a portable cooler of the invention.
Figure 2:
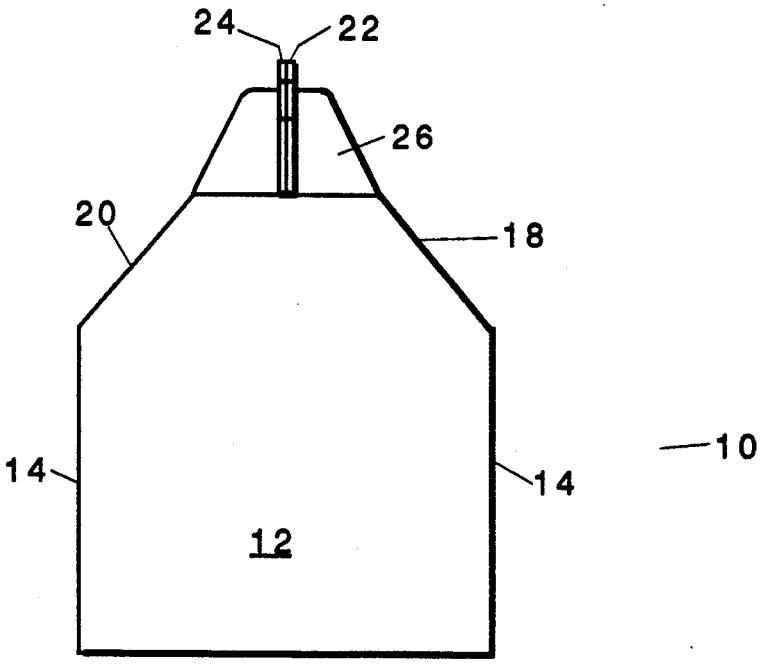
Figure 3:
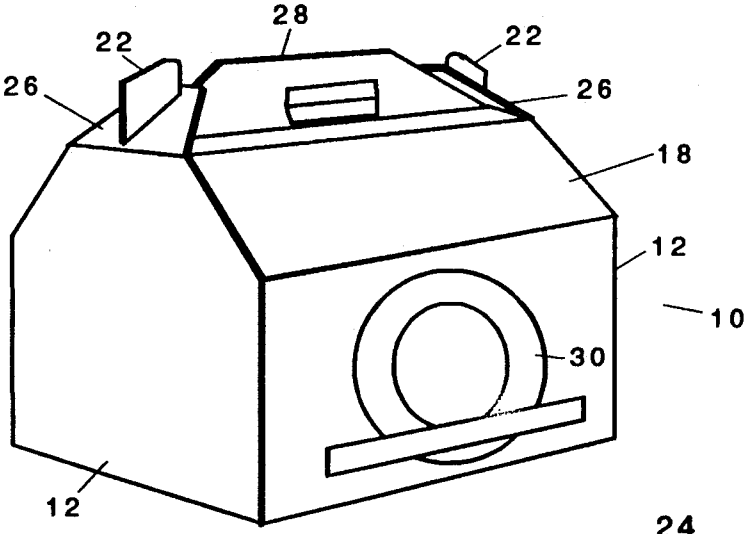
FIG. 3 is an isometric view of a portable cooler.
Figure 7:
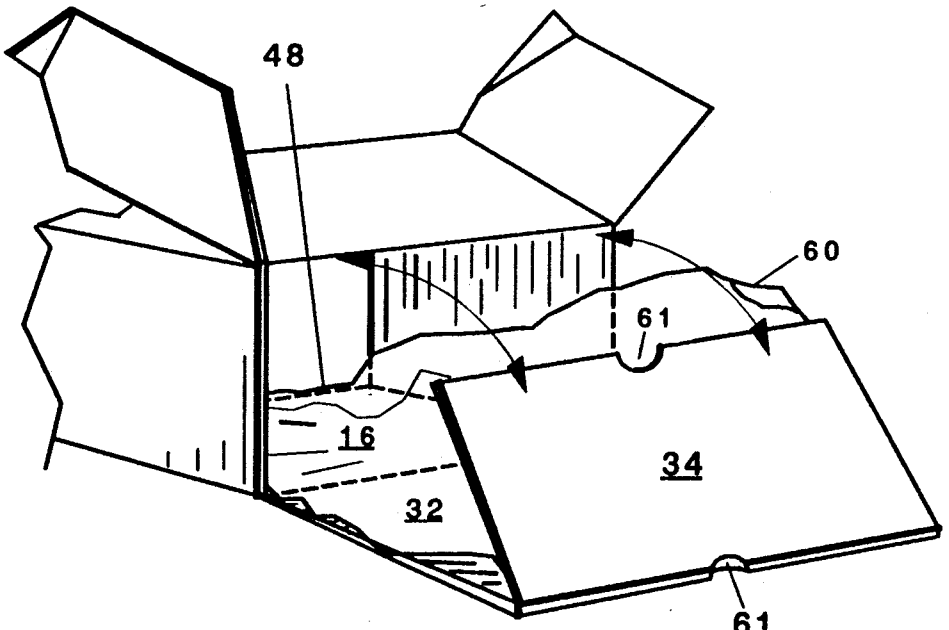
FIGS. 6 and 7 are isometric views showing the folding of a portable cooler and specifically of a flap attached to the plastic liner.
Figure 6:
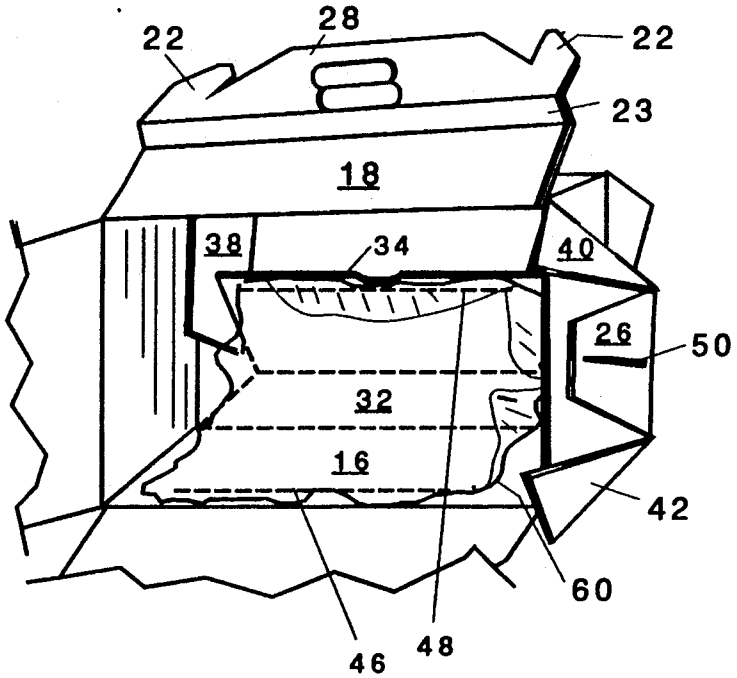

Referring to FIGS. 1, 2 and 3, portable cooler 10 has two sidewalls 12, a front wall 14 and a back wall 16. The front and back walls are provided with a sloping roof with a front slope 18 and back slope 20. These sloping portions are held in position by tabs 22 and 24 which mate with sloping side portion 26. Also provided is a handle 28. Walls 12, 14 and 16 of the portable cooler are adapted for provision of any desired logo on their surfaces. For example, as shown generally by the numeral 30.

Figure 5:
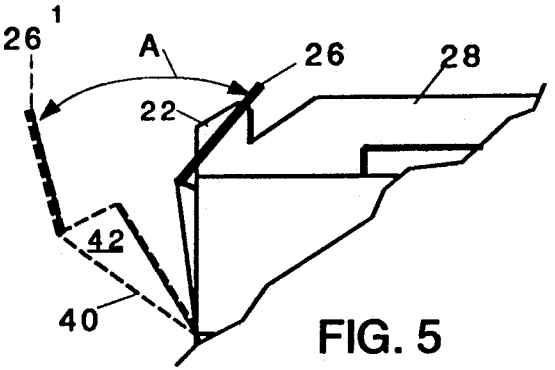
FIG. 5 is an diagrammatic representation of the unlatching of a side portion of a portable cooler from a top portion of the cooler.
Figure 4:
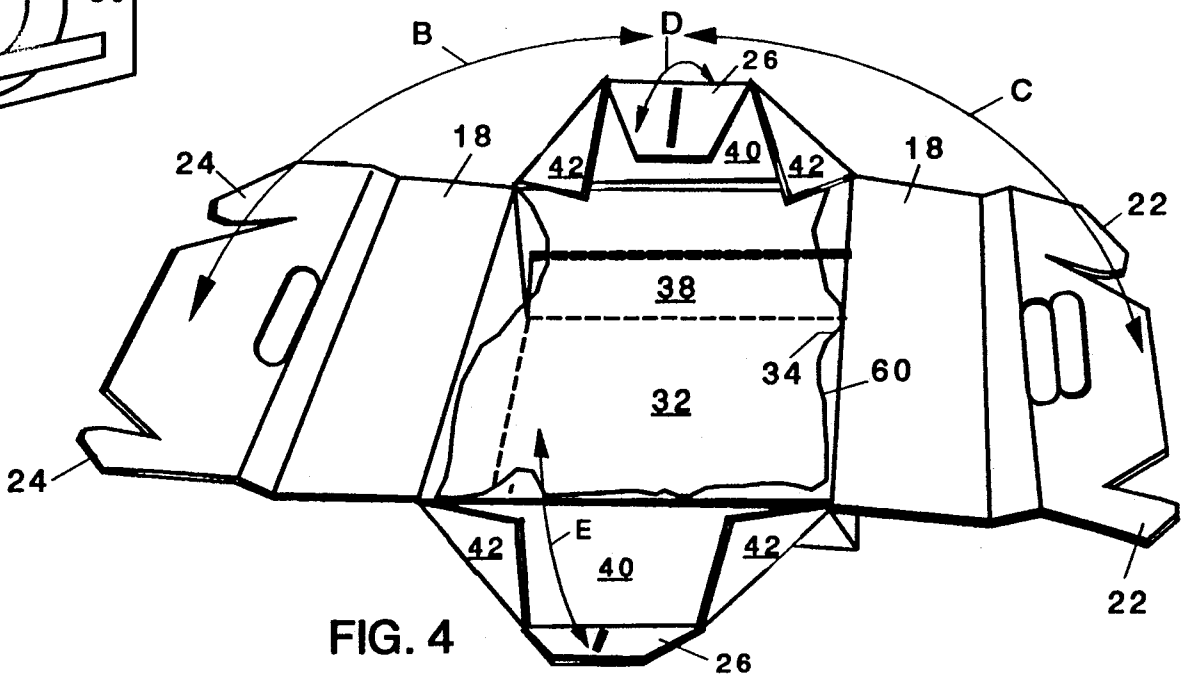
FIG. 4 is an isometric top view of an opened portable cooler of the invention, showing the method by which the portable cooler can be assembled or unfolded for storage.

Referring to FIGS. 4 through 9, there is shown the process by which portable cooler 10 can be unfolded and then re-folded to a convenient storing or carrying size shown in FIG. 9. FIG. 10 shows the template from which portable cooler 10 can be formed. Specifically, roof portions 18 are separated from sides 12 by removing portion 26 from tabs 22. Portion 26 and tabs 22 are interconnected by an aperture 50, and are readily disconnected as shown in FIG. 5 by lifting portion 26 and moving it as shown by arrow A. In this way the two top sloping portions 18 allow access to the internal volume of portable cooler 10 (FIG. 4). In the format shown in FIG. 4, portable cooler 10 can be filled with cool materials, and the top part of the cooler then reassembled simply by reversing the procedure shown in FIG. 5. Such reversal is shown by arrows B, C, D and E in FIG. 4. As is evident from FIG. 4, a plastic liner 60 in the form of an open-ended box is provided within portable cooler 10. Plastic liner 60 is attached at two locations to portable cooler 10 by glue lines shown in FIG. 6 as numerals 46 and 48. If desired, staples or other fastening means can be used to connect liner 60 with portable cooler 10. Indeed, the bag may be readily removed from the portable cooler and either replaced with a new bag or placed into another cooler, when so desired.

When use of the portable cooler is no longer desired, the cooler can be folded such that an upright inner side wall 34 (lying against the back of front wall 14) contacts an upper base wall 32, thus causing liner 60 to be folded upon itself. Upright wall 34 and base wall 32 may then be folded to contact back wall 16. At this time, internal partial sidewalls 38 may be folded inward to lower base 36, and lower base 36 and partial sidewalls 38 then again folded to contact either the inner or outer portion of front wall 14.

In FIG. 9, lower base 36 is in contact with the outer portion of wall 14. At the same time other wall portions or roof portions can be folded as shown in the figures to form the closed cooler shown in FIG. 9.

Critical to the invention is the provision of the upper base 32 and connected upright wall 34 which is connected to plastic liner 60. The ability to open upright wall 34 relative to upper base 32 allows opening and closing of the cooler and the liner attached thereto.

Eyelets 61 are provided at locations shown in FIG. 10 to aid movement by the user of each component of the cooler relative to one another. In addition, aperture 44 is provided in handle 28 to allow ready carrying of the cooler.

Other embodiments are within the following claims.

I claim:

1. A portable cooler comprising a base, a lid and four sidewalls, and further comprising an upper base and an inner sidewall and a liner shaped to fit within said four sidewalls, base and lid, said liner being fixedly attached to said inner sidewall and a said sidewall, and not being fixedly attached to any other portion of said portable cooler, wherein said liner is plastic.

2. The portable cooler of claim 1, wherein said cooler is formed from cardboard.

* * * * *